United States Patent [19]

Kallenbach

[11] Patent Number: 4,901,884

[45] Date of Patent: Feb. 20, 1990

[54] THERMOFORMED PACKAGE

[75] Inventor: James R. Kallenbach, Janesville, Wis.

[73] Assignee: Prent Corporation, Janesville, Wis.

[21] Appl. No.: 322,936

[22] Filed: Mar. 14, 1989

[51] Int. Cl.[4] ..... B65D 5/02

[52] U.S. Cl. ..... 220/339; 229/2.5 R; 493/902

[58] Field of Search ..... 220/339; 229/25 R, DIG. 4; 264/322, 324, 546; 493/56, 58, 79, 82, 162, 342, 373, 902

[56] References Cited

U.S. PATENT DOCUMENTS

| | | | |
|---|---|---|---|
| 1,772,106 | 8/1930 | Miller | 229/DIG. 4 |
| 2,734,676 | 2/1956 | Lawrence | 229/DIG. 4 |
| 3,551,940 | 1/1971 | Edison | 220/339 |
| 3,727,825 | 4/1973 | Troth | 229/DIG. 4 |
| 4,732,315 | 3/1988 | Gunn | 229/DIG. 4 |

FOREIGN PATENT DOCUMENTS

| | | | |
|---|---|---|---|
| 1436949 | 12/1968 | Fed. Rep. of Germany | 229/2.5 R |

*Primary Examiner*—Jimmy G. Foster
*Attorney, Agent, or Firm*—Howard M. Herriot

[57] ABSTRACT

Disclosed is a one-piece thermoformed plastic package blank having complementary first and second portions connected by a hinge, with a flange in one plane surrounding the portions and the hinge. The hinge in its central zone is at its maximum height above the flange plane, but is at a lower height in its end zones, tapering off to zero height at its ends, blending into the flange plane. The sidewalls of the hinge are of a negative draft slant undercut in the central zone, but are of a positive draft slant in the end zones of the hinge. To produce the finished package, the blank is die-cut to trim the flange and cut two "V"-shaped notches therein, each notch extending from the flange edge slightly into an end of the hinge, at the point of the "V". The resulting package has smooth hinge end edges and corners, without any sharp protrusions, and it folds properly and easily from open-mode to closed-mode, without application of considerable or excessive force.

7 Claims, 5 Drawing Sheets

THERMOFORMED PACKAGE

BACKGROUND OF THE INVENTION

Known in the prior art is the one-piece flanged, hinged container package of plastic, which is made by thermoforming and die-cut trimming, into an open container of two complementary package portions, usually halves, that are connected by a hinge portion, whereby either of the two package portions may swing about the hinge portion to form a closed container or package. The roof of the hinge, through the entire length of the hinge, is above and parallel to the flange plane, supported by the sidewalls of the hinge, which sidewalls have an undercut slant, i.e. are not perpendicular to the flange but are slanted therefrom with a negative draft along their entire length, from end-to-end. When the die-cut trimming occurs, the cutting through the raised roof of the hinge causes deformation of the hinge. This deformation may not necessarily hinder the function of the hinge, but sometimes it does, and at the least, it degrades the aesthetics of the package. Further, however, this crush-cutting causes the sidewalls of the hinge to collapse as the cut is made, the cut being completed as the sidewalls are in the collapsed state with part of the hinge plastic folded over itself. This results in a sharp burr, spear or spike of plastic protruding from each end corner of the hinge. In using the package, these sharp protrusions can cut through a person's skin, and can also pierce through outer packaging materials that cover the thermoform package. In medical packaging, such outer covers are often used to seal in a sterilized thermoform package, and this piercing can destroy the sterility that has been provided.

SUMMARY OF THE INVENTION

This invention provides a one-piece, flanged, hinged package of thermoformed plastic, die-cut trimmed, which has smooth hinge end edges and corners where cut, without sharp protrusions, and which folds properly and easily so that the package may be closed without having to apply excessive force.

the invention also provides a thermoformed blank for such a package, prior to die-cut trimming, which blank may be die-cut trimmed without any collapse-folding of the hinge portion upon itself, to thereby produce a package free of such sharp protrusions, and free of flange warp, bow or pucker, so that the package will close properly, have improved aesthetics, and have safe, smooth hinge end edges.

A summary description is set forth in the Abstract of Disclosure, and reference is to be had thereto.

An object of the invention is to provide a package blank, and a package trimmed therefrom, of the type hereinabove referred to, wherein the hinge portion has a lower profile in its end zones than in its central zone.

A further object is to provide such a package blank and package wherein the hinge sidewalls have a negative draft in the central zone of the hinge portion, and have an opposite, positive draft at the end zones of the hinge portion.

Still another object is to provide such a blank wherein the hinge sidewalls decrease gradually in height from the central zone to each end zone of the hinge portion, so that the hinge roof is lower in the end zones than in the central zone of the hinge, coming to zero height to blend into the flange plane at the main cut trim line.

A still further object is to provide such a blank wherein the hinge roof is at its maximum height in the central zone of the hinge, dropping to zero height at the ends zone thereof, blending into the flange plane at those ends, and the sidewalls of the hinge are of negative draft slant in the central zone, and of positive draft slant in the end zones.

It is also an object to provide such a blank and package wherein "V-shaped notches are die cut in the flange edge near the end zones of the hinge, with the point of the "V" extending somewhat into the end of the hinge.

FIGS. A–G, illustrate the comparable prior art, in views comparable to FIGS. 1–7, respectively.

Figure 1:
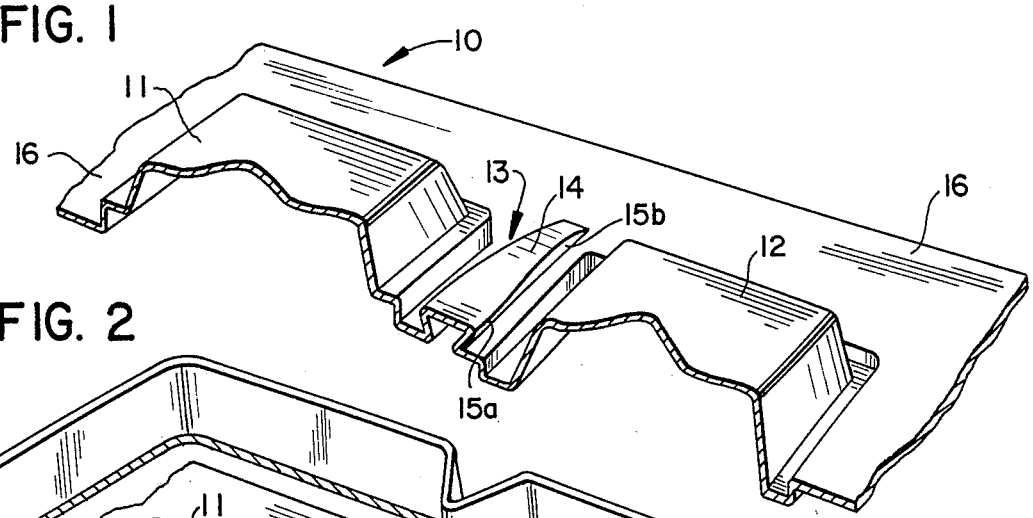
FIGS. 1–7 illustrate the package blank and the package of the invention, and show the successive stages in making the package, from the thermoformed blank to the die-cut, flange trimmed, and hinge-notched finished product.
Figure 2:
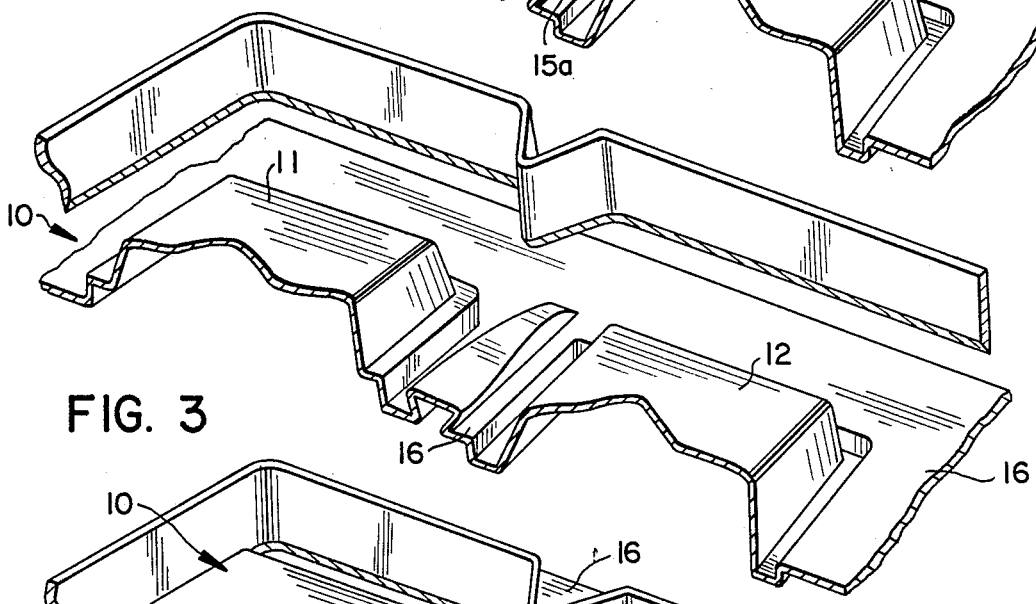
Figure 3:
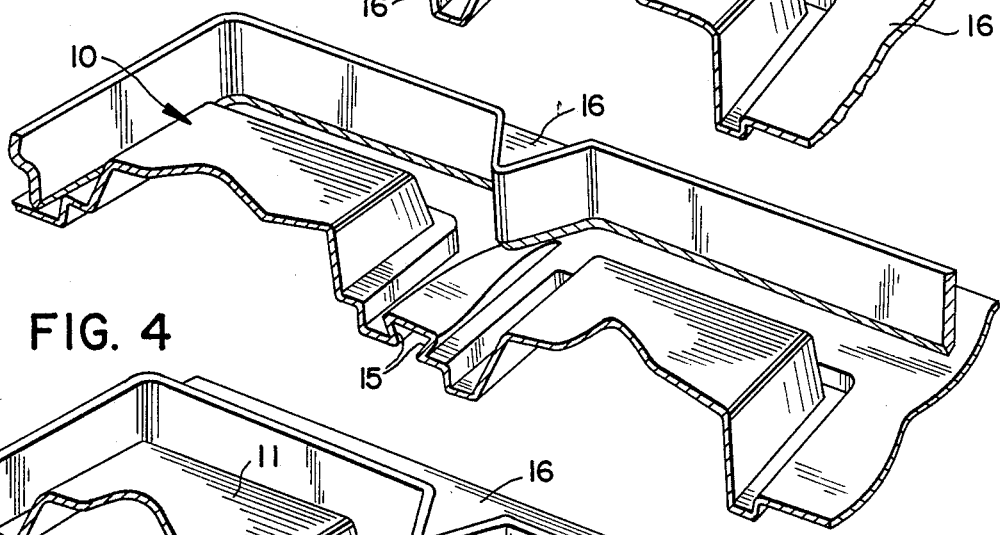
Figure 4:
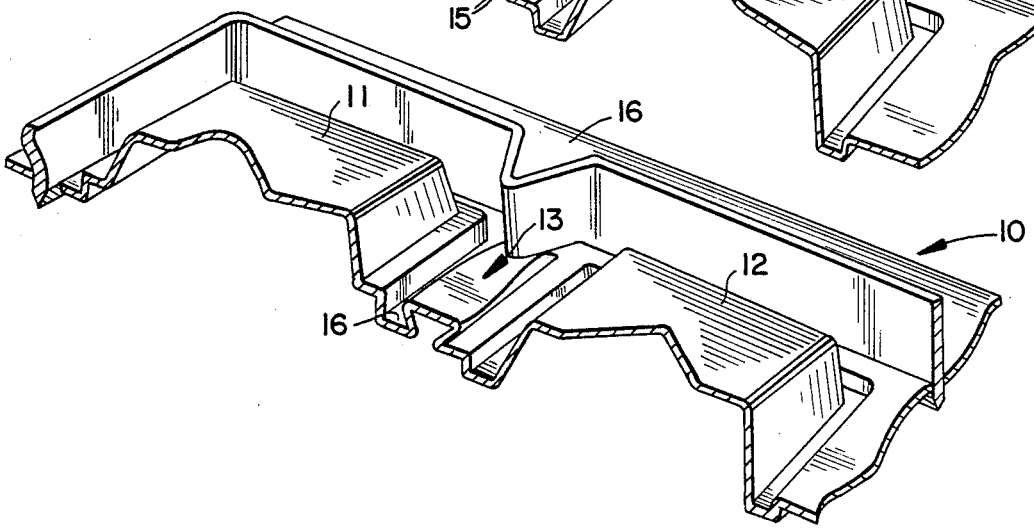
Figure 5:
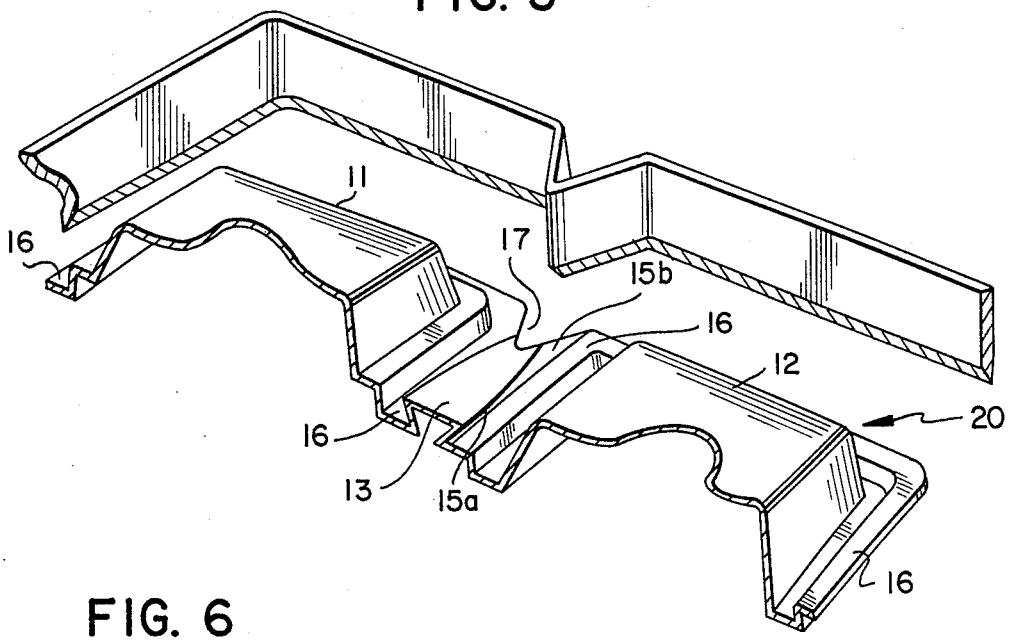
Figure 6:
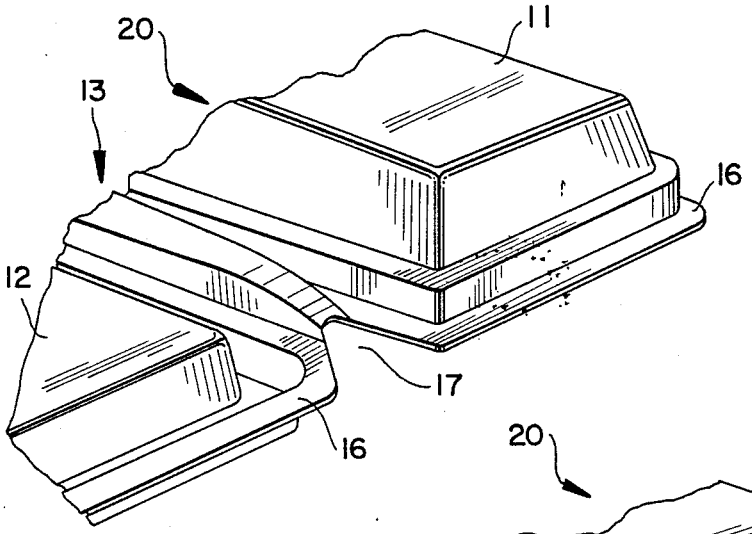
Figure 7:
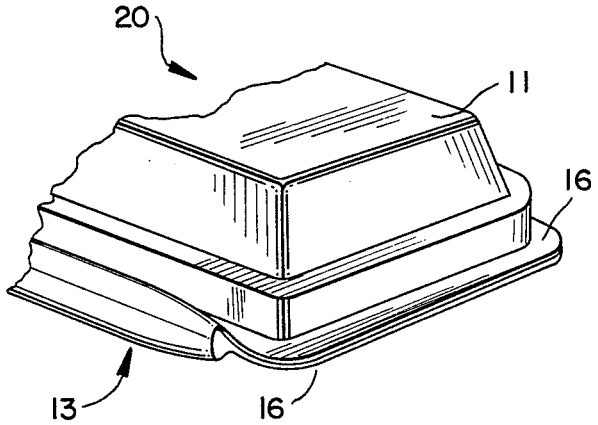

FIG. 1 is an isometric fragmentary view of a portion of a thermoformed package blank embodying the invention, showing about one-half of the blank, a portion of the blank being not shown, having been torn away;

FIG. 2 is a view similar to FIG. 1, showing in addition to the blank, a cut-die positioned in place above the blank prior to starting to cut-trim the blank;

FIG. 3 is a similar view, when the cut-die has been lowered into engagement with the end zones of the hinge portion of the blank;

FIG. 4 is a similar view, showing the cut-die cutting entirely through the blank;

FIG. 5 is a similar view, the cut-die having been raised up after completion of the cutting operation;

FIG. 6 is another view of the package shown in FIG. 5, but turned ninety degrees from its position shown in FIG. 5; and FIG. 7 is a view of the finished package, from the same angle as in FIG. 6, but shown in the closed container mode, with the bottom portion having been swung about the hinge to a position under the top portion with the flange meeting itself.

Figure 8:
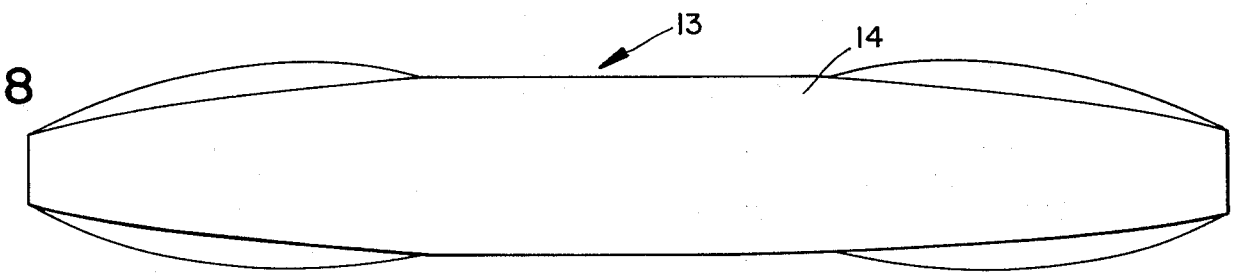
FIGS. 8–14 illustrate the hinge portion of the package blank of the invention.
Figure 9:
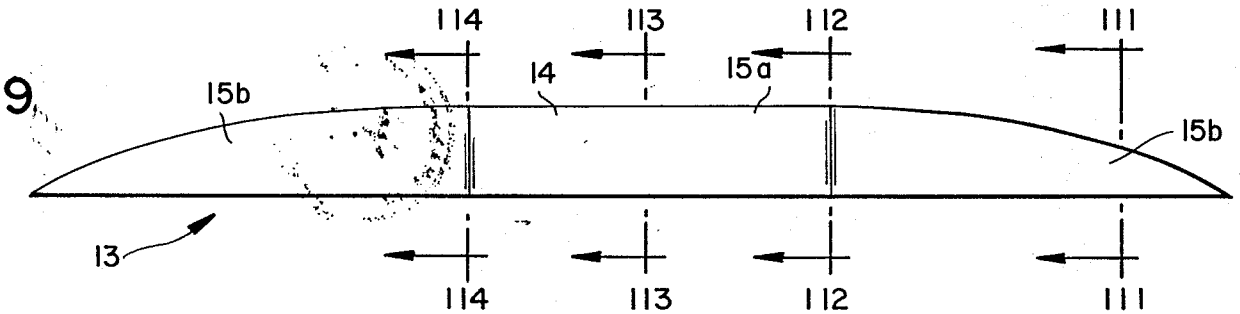
Figure 10:
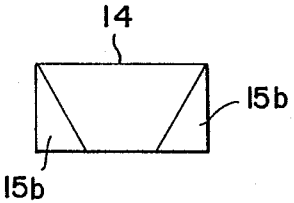
Figure 11:
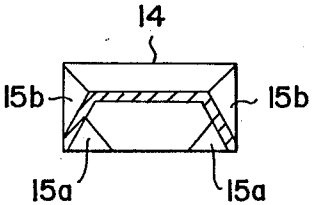
Figure 12:
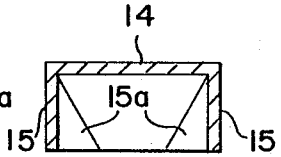
Figure 13:
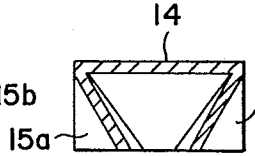

FIG. 8 is a top plan view of just the hinge portion of the package blank of this invention;

FIG. 9 is a side elevation thereof;

FIG. 10 is an end elevation thereof;

FIG. 11 is a sectional view on line 111 of FIG. 9;

FIG. 12 is a sectional view on line 112 of FIG. 9;

FIG. 13 is a sectional view on line 113 of FIG. 9; and

Figure 14:
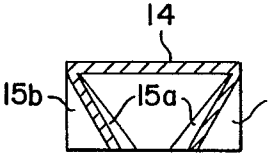
Figure 15:
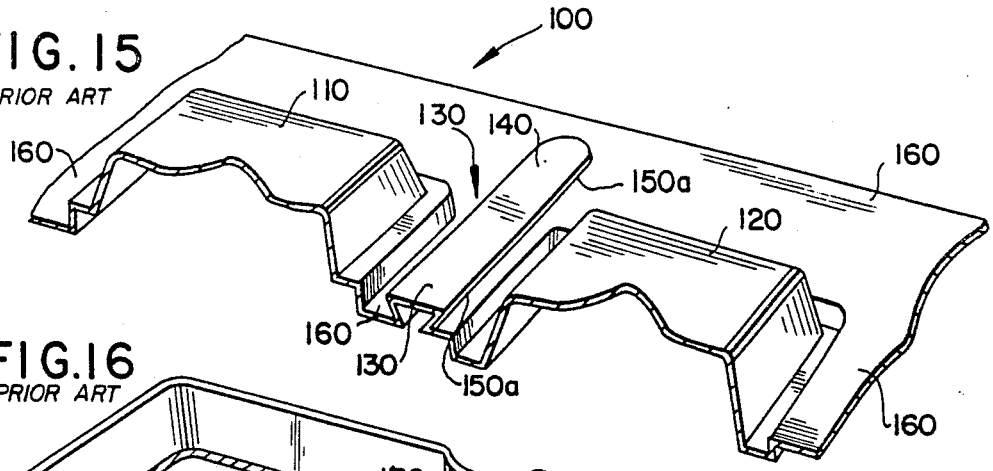
FIG. 15 PRIOR ART
Figure 16:
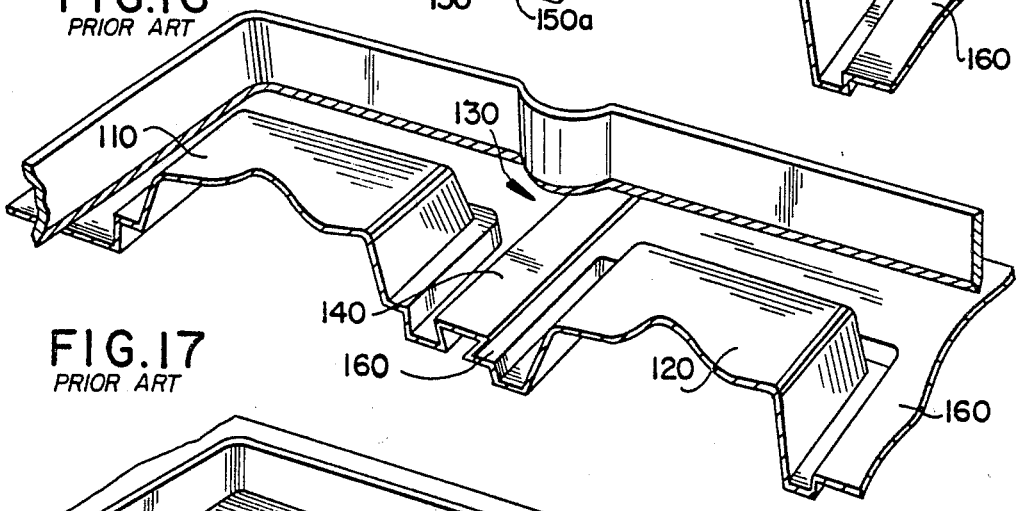
FIG. 16 PRIOR ART
Figure 17:
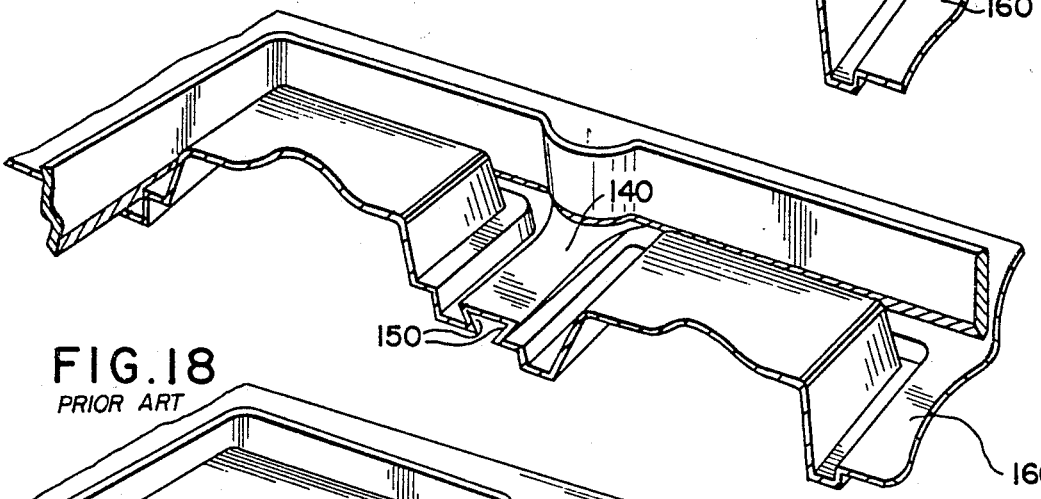
FIG. 17 PRIOR ART
Figure 18:
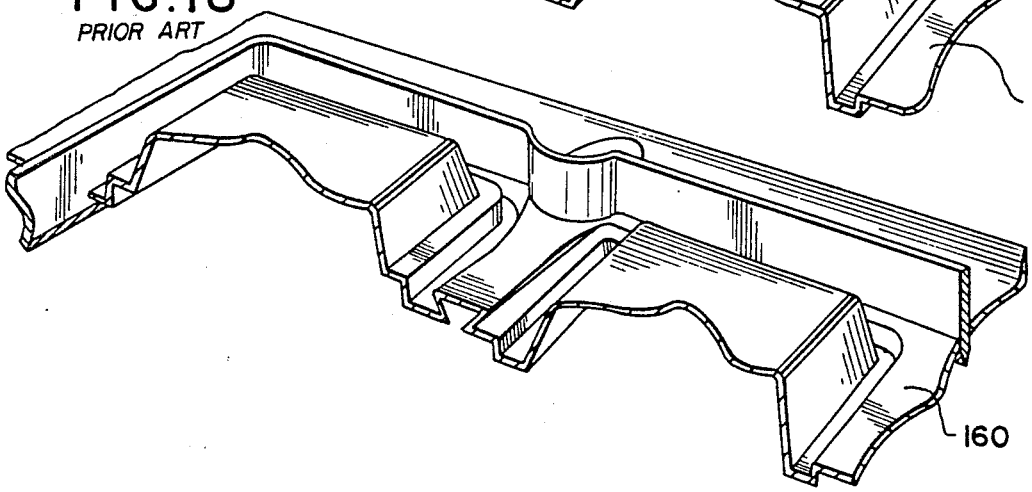
FIG. 18 PRIOR ART
Figure 19:
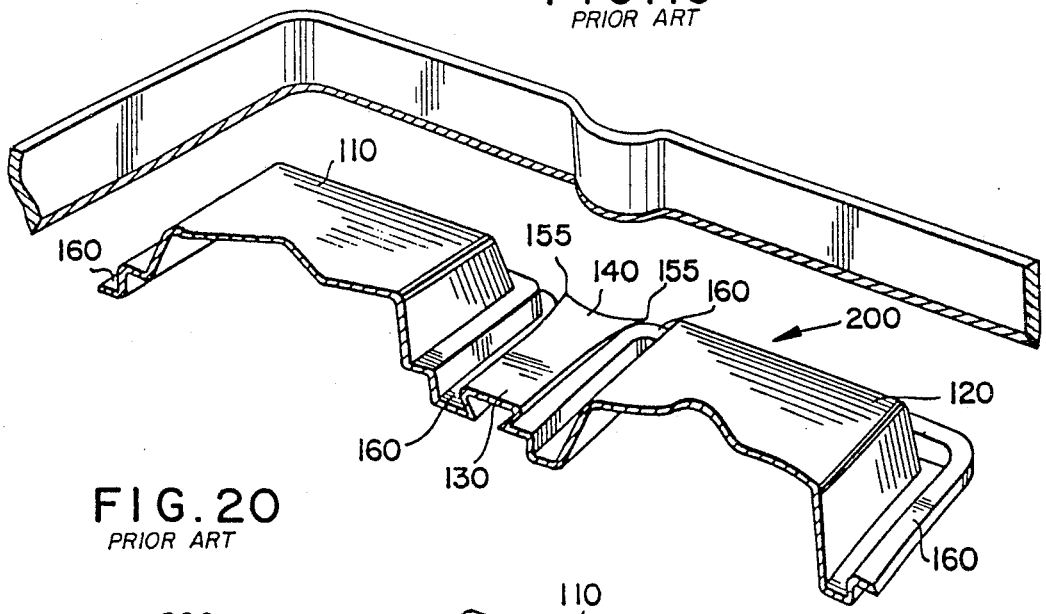
FIG. 19 PRIOR ART
Figure 20:
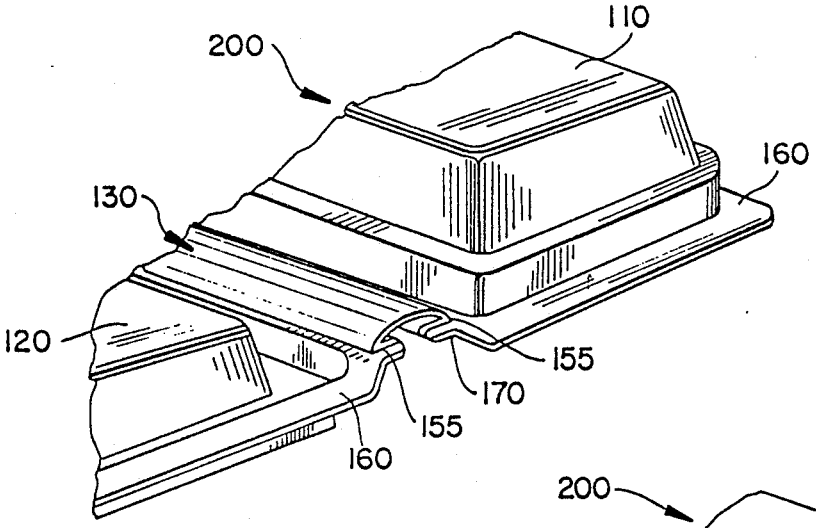
FIG. 20 PRIOR ART
Figure 21:
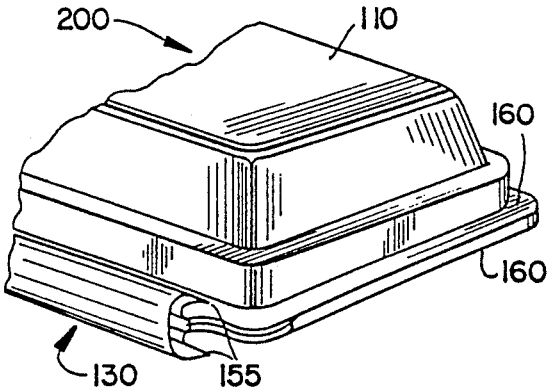
FIG. 21 PRIOR ART

FIG. 14 is a sectional view on line 114 of FIG. 9.

DETAILED DESCRIPTION

Referring to the drawing, Figs. A through G illustrate the prior art, and show a package blank 100 having a first or top portion 110 and a second or bottom portion 120 connected by a hinge 130. A flange 160 extends around the perimeter of the top and bottom portions and of the hinge. The hinge has a roof 140 spaced from and parallel to flange 160 being supported by hinge sidewalls 150, each of which is undercut or slanted with a negative draft along its entire length as shown at 150*a*. FIG. A shows the blank 100 after it has been thermoformed, and shows that the hinge roof is above the flange plane throughout the entire length of the hinge. FIG. B shows the blank prior to cutting to trim the flange, showing the cut die above the blank. FIG. C shows the cut die lowered into near-engagement with the flange and into engagement with the hinge, which is elevated above the flange, deforming the hinge prior to cutting. FIG. D shows the hinge deformed outwardly, collapsing under the pressure of the cut die as it is lowered further cutting the flange and the hinge; the hinge being completely cut through, but only when the cut die reaches the flange plane. FIG. E shows the cut die raised up, showing the trimmed blank, which is now the finished package 200, and shows the sharp or ragged projections 155 at the outside ends or corners of the hinge, which protrusion points 155 are a result of the deformation of the hinge collapsing the hinge sidewalls over on themselves during the crush-cutting operation. The package 200 has a blunt "U"-shaped recess 170 extending into the flange with the bight of the "U" extending into the hinge end. FIG. F shows the finished package 200 with the hinge partially sprung back to its former position, which partial spring-back is the limit of its spring-back because of its being stressed along a crisp edge with little structure. This deformed hinge sometimes requires excessive tension or force to fold the package closed. FIG. G shows the finished package folded to closed container position, showing the sharp burrs, spears, points or spike projections 155 at the hinge end corners.

FIGS. 1 through 14 illustrate the invention. FIG. 1 shows the package blank 10 of this invention, having a first or top portion 11 and a second or bottom portion 12 connected by a hinge 13. A flange 16 surround the top portion, the bottom portion and the hinge. The hinge 13 has a roof 14 supported by hinge sidewalls 15. The sidewalls are of lesser height at the end zones of the hinge than at the central zone thereof, the sidewalls lessening in height to zero height at the ends of the hinge so that the roof 14 of the hinge lessens in height from the central zone to the end zone and blends into the flange plane. The sidewalls 15 are undercut or of negative draft slant as shown at 15a in the central zone of the hinge, but blend from that negative draft slant to a positive draft slant as shown at 15b in the end zone of the hinge, so that the hinge tapers and blends into the flange plane at the ends of the hinge. FIG. 2 shows the blank 10, just prior to cutting it, with a cut die positioned above the blank; and FIG. 3 shows the cut die lowered into near engagement with the flange 16 and into engagement with the low profile end zone of the hinge, deforming the hinge. FIG. 4 shows the cut die lowered further into the complete cut-through position, with the hinge deformed, but deformed in a controlled, acceptable way because of the tapered, blending, lower hinge end, permitting a controlled, acceptable collapsing of the hinge end inwardly rather than outwardly. FIG. 5 shows the cut die raised up, showing the blank, after the cut-through trimming operation, which trimmed blank has now become the finished package 20, with a "V"-shaped recess 17 extending into the package from the edge of the flange with the point of the "V" extending somewhat into the low profile end of the hinge. This has allowed the hinge to be cut through at an oblique angle, in the shallow or low profile, positive draft zone, assuring a minimum of fold-over or distortion. FIG. 6 shows the finished package with the hinge sprung-back after cutting, and showing the "V" recess at the package edge with its point extending somewhat into the hinge end. This hinge now is free of any sharp protusions, and will fold properly and easily so that the package may be closed without having to apply a considerable or excessive tension or force. FIG. 7 shows the finished package 20 in closed container position with the second or bottom portion 12 swung about hinge 13 to be under the first or top portion 11 with the flange 16 meeting itself, with the upper flange portion and lower flange portion lying in adjacent parallel planes. The flange meets itself nicely without any flange warp, pucker or bow, so the package closes properly. The hinge ends are without sharp protrusions of any kind, presenting a safe, smooth edge.

What is claimed is:

1. A one-piece thermoformed package blank comprising complementary first and second portions connected by a hinge, and having a flange in one plane surrounding said portions and said hinge, wherein said hinge in its central zone is above said plane a greater height than in its end zones, and wherein said hinge comprises a roof and a pair of sidewalls supporting said roof, the sidewalls having a negative draft undercut slant in said central zone and a positive draft opposite slant in said end zones.

2. The invention of claim 1 wherein said hinge tapers to zero height at its ends.

3. A one-piece thermoformed package comprising complementary first and second portions connected by a hinge, and having a flange which, when the package is in the open mode, is in one plane surrounding said portions, wherein said hinge in its central zone is above said plane a greater height than in its end zones, and wherein said hinge extends across the package from one edge of the flange to the opposite edge thereof.

4. The invention of claim 3 wherein the flange edge, at each end of said hinge, has a "V"-shaped notch, the "V" point of which extends somewhat into said end zones.

5. The invention of claim 3 wherein said hinge comprises a roof and a pair of sidewalls supporting said roof, the sidewalls having a negative draft undercut slant in said central zone and a positive draft opposite slant in said end zones.

6. The invention of claim 5 wherein the flange edge, at each end of said hinge, has a "V"-shaped notch, the "V" point of which extends somewhat into said end zones.

7. The invention of claim 6 wherein the "V"-shaped notch has a rounded corner at each of the three points of the "V".

* * * * *